United States Patent [19]

Romansky

[11] Patent Number: 4,493,982

[45] Date of Patent: Jan. 15, 1985

[54] HOLDER APPARATUS FOR HEATER ELEMENT

[75] Inventor: John A. Romansky, Rochester, N.Y.

[73] Assignee: Eastman Kodak Company, Rochester, N.Y.

[21] Appl. No.: 534,522

[22] Filed: Sep. 21, 1983

[51] Int. Cl.[3] ..... F24H 3/00

[52] U.S. Cl. ..... 219/469; 219/216; 219/244; 219/541; 339/255 R

[58] Field of Search ..... 219/243, 244, 388, 469, 219/470, 471, 411, 541; 200/51 R; 339/111, 151 B, 255 R

[56] References Cited

U.S. PATENT DOCUMENTS

| | | | |
|---|---|---|---|
| 2,634,349 | 4/1953 | Genter | 339/255 R X |
| 3,171,183 | 3/1965 | Johnston | 339/255 R X |
| 3,851,944 | 12/1974 | Gauzert et al. | 339/255 R X |
| 3,869,696 | 3/1975 | Snowden | 362/457 |
| 3,912,901 | 10/1975 | Strella | 219/216 |
| 3,989,341 | 11/1976 | Ball | 339/255 R X |
| 4,050,803 | 9/1977 | McCarroll | 355/3 R |
| 4,113,339 | 9/1978 | Eley | 339/111 |
| 4,116,749 | 9/1978 | Dufort et al. | 219/469 X |
| 4,212,631 | 7/1980 | Franles et al. | 219/469 X |
| 4,229,950 | 10/1980 | Fessenden | 64/5 |
| 4,281,888 | 8/1981 | Seaman | 339/151 B |

*Primary Examiner*—Volodymyr Y. Mayewsky
*Attorney, Agent, or Firm*—William F. Noval

[57] ABSTRACT

Apparatus for removably holding a heater element having at least one end with an electrical contact. The apparatus includes a body of heat and electrically insulating material having a first segment for releasably and solely supporting an elongated heater element by the contact end of said element and a second segment connected to and axially aligned with said first segment for mounting an electrical terminal which engages the contact at the end of a supported heater element. A third segment extends from the body for manually gripping the holder apparatus without danger of thermal hazard or contamination so that the heater element may be installed in and removed from a work station such as a heated fuser roller.

3 Claims, 2 Drawing Figures

HOLDER APPARATUS FOR HEATER ELEMENT

BACKGROUND OF THE INVENTION

This invention relates generally to apparatus for holding a heater element and more particularly this invention relates to apparatus for releasably and solely supporting a heater element by a contact end of said element without danger of thermal hazard or contamination.

In electrographic copiers, one technique for fixing a toner image to a copy sheet is by passing the copy sheet through the nip of a pair of rollers at least one of which is heated by a heater element (e.g. a quartz lamp) positioned within the roller. In installing and removing a heater element for replacement and servicing, a thermal hazard exist for the service person since the heater element may be hot. While the heater element is still hot, it may only be handled through the use of heat-resistant gloves or a special removal tool. Handling of the element by its glass envelope can cause breakage or contamination to the surface. Contamination (e.g. fingerprint) causes a hot spot which reduces lamp life. Thus, in order to prevent thermal hazard and contamination, it has been found necessary to allow the heater element to cool to a safe temperature and to avoid touching the glass envelope.

It is thus desirable to provide a holder for a heater element which permits removal of the heater element without waiting for it to cool down to a temperature where it may be handled without thermal hazard. It is also desirable to provide a holder for the heater element which permits easy removal of the heater element by a service person without danger of either thermal hazard or contamination and which may be manipulated with one hand for ease of servicing.

SUMMARY OF THE INVENTION

According to the present invention, there is provided apparatus for removably holding a heater element which permits installation and removal of the heater element without termal hazard to a service person and contamination to the lamp. The apparatus includes means for releasably and solely supporting a heater element by a contact end of the element and means connected to and axially aligned with said holding means for mounting an electrical terminal which engages the contact end of a supported heater element. The supporting means and mounting means comprise heat and electrical insulating material.

According to one aspect of the invention, the apparatus includes means for providing a grip for manually gripping said apparatus without danger of thermal hazard or contamination. According to another aspect of the invention, the apparatus comprises a holder for removably supporting a heater element by one end comprising a body of heat and electrically insulating material having a first segment for releasably and solely supporting a heater element by a contact end of said element and a second segment axially aligned with said first segment for mounting an electrical terminal in engagement with a supported heater element electrical contact.

The invention and its objects and advantages will become more apparent in the detailed description of the preferred embodiment presented below.

BRIEF DESCRIPTION OF THE DRAWINGS

In the detailed description of the preferred embodiments of the invention presented below, reference is made to the accompanying drawings like elements having like numbers in which.

DESCRIPTION OF THE PREFFERRED EMBODIMENT

Figures 1, 2:
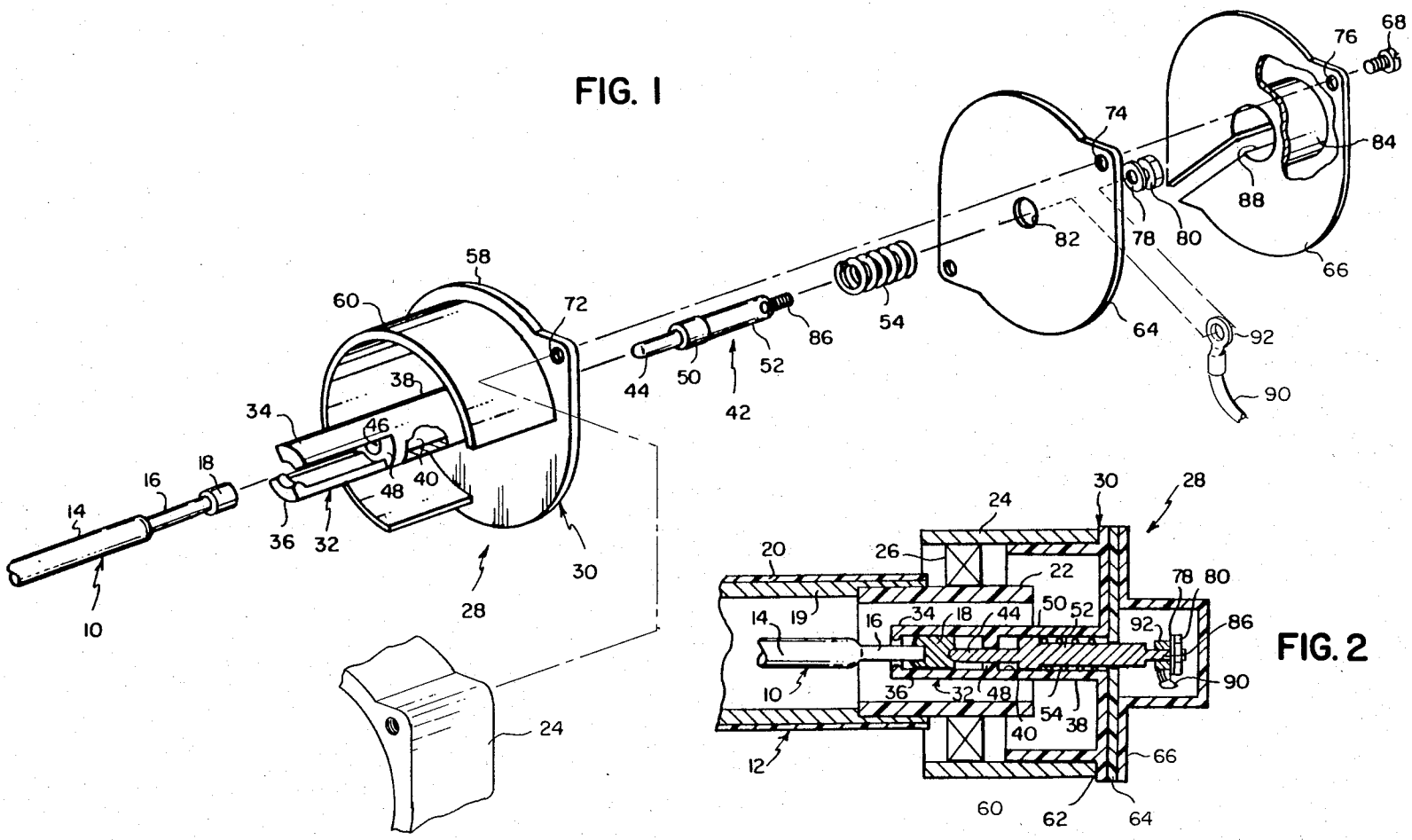
FIG. 1 is an exploded perspective partially sectional view of an embodiment of holder apparatus according to the present invention.
FIG. 2 is a cross-sectional elevational view of the apparatus of FIG. 1 shown positioned within a support bracket for a heated fuser roller.

Referring now to the drawings, there is shown a preferred embodiment of apparatus for removably holding a heater element solely by a contact end of said element. As shown, a heater element 10 is supported within a work station such as fuser roller 12 for fixing a toner image to a support (not shown). Heater element 10 comprises a cylindrical lamp 14 having a contact end 16 with electrical contact 18 of partially cylindrical shape. Fuser roller 12 includes a cylindrical core 19 of thermally conductive material such as aluminum with an outer layer 20 of high temperature resistant material such as polytetrafluoroethylene having good release properties. Roller 12 has an end gudgeon 22 of heat insulating material rotatably mounted in fuser station member 24 by bearing 26. Element 10 is concentrically mounted within roller 12 by means of holder apparatus 28 which includes a cylindrical body 30 of heat and electrically insulating material such as plastic.

Body 30 includes a first segment 32 for releasably and solely supporting element 10 by resilient arms 34 and 36 which are configured to grip electrical contact 18 of element 10. A second cylindrical segment 38 of body member 30 is integral with and axially aligned with first segment 32 and has a cylindrical recess 40 for slidably supporting electrical terminal 42. Terminal 42 has a first portion 44 which extends through aperture 46 in wall 48 of member 30 to engage contact 18 of element 10; a second portion 50 which is dimensioned slightly smaller than recess 40 to slide therein but larger than aperture 46 to abut against wall 48; and a third portion 52 dimensioned smaller than portion 50 and about which spring 54 is coiled.

Body 30 also includes a third cup-shaped segment having a circular member 58 integral with and extending radially from segment 38 and a partially cylindrical member 60 concentric with segment 38. Member 60 is dimensioned to slip fit into the end of member 24 with member 58 abutting the end 62 of member 24.

Holder apparatus 28 also includes a substantially circular plate member 64 of heat and electrically insulating material such as plastic and a cup-shaped cover member 66, also of heat and electrically insulating material. Members 66, 64 and 30 are sandwiched with member 24 by means of screws 68 which pass through holes 76, 74 and 72 respectively in members 66, 64, 30 and threads into member 24. Portion 52 of electrical terminal 42 extends through hole 82 in member 64. Terminal 42 is biased into engagement with contact 18 by the compression of spring 54 between terminal portion 50 and member 64.

Cup segment 84 of member 66 receives the terminal portion 86 of terminal 42 and has a slot 88 for entry of an electrical conductor 90 terminated to terminal portion 86 by connector 92, washer 78 and nut 80. By removing screws 68, holder apparatus 28 may be removed from member 24 by a service person using one hand. Heater element 10 may thus be removed from within roller 20 without danger of thermal hazard or contamination to element 10.

The invention has been described in detail with particular reference to the preferred embodiments thereof but it will be understood that variations and modifications can be effected with the spirit and scope of the invention.

What is claimed is:

1. A fuser station comprising:

a fuser roller;

a heater element concentrically located within said roller, said element having at least one end with a generally cylindrical electrical contact;

holder apparatus including a body of heat and electrically insulating material, said body having a first end with at least two resilient arms having inner surfaces spaced from each other which define a receptacle for said generally cylindrical contact end of said heater element, the gripping force effected solely by the resiliency of said arms gripping the contact end of said element to provide the sole support for said heater element during insertion and removal of said heater element relative to said fuser roller; said body having a second end integral with said first end, said second end having a recess which is axially aligned with and which communicates with said receptacle; said body further having a cup-shaped segment including a member integral with and extending radially from said second end and at least partially cylindrical mounting member concentric with said end;

a support member rotatably mounting said fuser roller, said support member having a recess which is dimensioned to provide a slip fit for said mounting member of said body, said cup-shaped segment of said body providing a grip for manually gripping said body to insert and remove said body from said support member; and said holder apparatus also including an electrical terminal slidably mounted in said recess in said second end of said body, said terminal having a portion extending into said receptacle and engaging the electrical contact of said heater element.

2. The fuser station of claim 1 wherein said holder apparatus further includes (1) a plate member of insulating material; (2) a hollow cover member of insulating material; and (3) means for sandwiching said plate member and said cover member with said cup-shaped segment of said body.

3. The fuser station of claim 2 wherein said plate member of said holder apparatus has a centrally disposed hole; wherein said electrical terminal has a portion extending through said hole of said plate member into said hollow cover member; and including a spring coiled around said electrical terminal, said spring being compressed within said recess of said second end of said body by means of said plate member and coacting with said electrical contact to bias said contact into engagement with said contact end of said heater element.

* * * * *